US007232513B1

(12) United States Patent
Webb et al.

(10) Patent No.: US 7,232,513 B1
(45) Date of Patent: Jun. 19, 2007

(54) ELECTROPLATING BATH CONTAINING WETTING AGENT FOR DEFECT REDUCTION

(75) Inventors: Eric G. Webb, Salem, OR (US); Jonathan D. Reid, Sherwood, OR (US); John H. Sukamto, Tualatin, OR (US); Yuichi Takada, Yokohama (JP)

(73) Assignee: Novellus Systems, Inc., San Jose, CA (US)

( * ) Notice: Subject to any disclaimer, the term of this patent is extended or adjusted under 35 U.S.C. 154(b) by 234 days.

(21) Appl. No.: 10/879,613

(22) Filed: Jun. 29, 2004

(51) Int. Cl.
*C25D 3/38* (2006.01)
*C25D 5/02* (2006.01)

(52) U.S. Cl. ..... 205/298; 205/296; 205/297; 205/123

(58) Field of Classification Search ..... 205/238, 205/239, 261, 296, 80, 81, 123, 297, 298
See application file for complete search history.

(56) References Cited

U.S. PATENT DOCUMENTS 4,975,159 A * 12/1990 Dahms ..... 205/125
5,969,422 A 10/1999 Ting ..... 257/762
6,113,771 A 9/2000 Landau ..... 205/123
6,261,433 B1 * 7/2001 Landau ..... 205/96
6,444,110 B2 * 9/2002 Barstad et al. ..... 205/123
6,607,654 B2 * 8/2003 Lee et al. ..... 205/296
6,673,226 B1 * 1/2004 Kogan et al. ..... 205/81
6,943,112 B2 * 9/2005 Basol et al. ..... 438/687
2002/0064592 A1 5/2002 Datta ..... 427/98
2005/0081744 A1 * 4/2005 Klocke et al. ..... 106/1.18

OTHER PUBLICATIONS

BASF, "Pluronic L62D Block Copolymer Surfactant", Technical Bulletin, © no month, 2002.*

* cited by examiner

*Primary Examiner*—Edna Wong
(74) *Attorney, Agent, or Firm*—Thomas Swenson

(57) ABSTRACT

An electroplating solution contains a wetting agent in addition to a suppressor and an accelerator. In some embodiments, the solution has a cloud point temperature greater than 35° C. to avoid precipitation of wetting agent or other solute out of the plating solution. In some embodiments, the wetting agent decreases the air-liquid surface tension of the electroplating solution to 60 dyne/cm$^2$ or less to increase the wetting ability of the solution with a substrate surface. In some embodiments of a method for plating metal onto substrate surface, the electroplating solution has a measured contact angle with the substrate surface less than 60 degrees.

16 Claims, 4 Drawing Sheets

ELECTROPLATING BATH CONTAINING WETTING AGENT FOR DEFECT REDUCTION

FIELD OF THE INVENTION

The present invention pertains to the field of electroplating of integrated circuit substrate wafers, particularly to electroplating solutions having improved wetting ability to decrease defects in plated metal.

BACKGROUND OF THE INVENTION

Integrated circuits are formed on wafers by well-known processes and materials. These processes typically include the deposition of thin film layers by sputtering, metal-organic decomposition, chemical vapor deposition, plasma vapor deposition, and other techniques. These layers are processed by a variety of well-known etching technologies and subsequent deposition steps to provide a completed integrated circuit.

A crucial component of integrated circuits is the wiring or metallization layer that interconnects the individual circuits. Conventional metal deposition techniques include physical vapor deposition, e.g., sputtering and evaporation, and chemical vapor deposition techniques. Some integrated circuit manufacturers are investigating electrodeposition techniques to deposit primary conductor films on semiconductor substrates.

Wiring layers traditionally contained aluminum and a plurality of other metal layers that are compatible with the aluminum. In 1997, IBM introduced technology that facilitated a transition from aluminum to copper wiring layers. This technology has demanded corresponding changes in process architecture towards damascene and dual damascene architecture, as well as new process technologies.

A typical damascene or dual damascene process flow scheme for fabricating copper interconnects, such as copper lines and vias, typically includes: forming a trench pattern on a layer dielectric layer using an etch-resistant photoresist; etch a trench pattern; remove the photoresist; forming a via pattern on a dielectric material using etch resistant photoresist; etching vias; removing resist; depositing a tantalum barrier and a copper seed layer using PVD; electroplating copper to fill the etched features; and polishing copper off the wafer face leaving copper-filled interconnect circuitry.

Copper damascene circuits are produced by initially forming trenches and other embedded features in a wafer, as needed for circuit architecture. These trenches and embedded features are formed by conventional photolithographic processes in a nonconductive substrate, such as a silicon oxide. A barrier layer, e.g., of silicon nitride or tantalum, is deposited next. An initial seed or strike layer typically comprising copper and having a thickness of about 20 nanometers (nm) to 200 nm is then deposited by a conventional physical or vapor deposition technique. The seed layer is used as a base layer to conduct current for electroplating thicker films. Thinner seed layers are preferred so as to reduce overhang and closure of very small features with metal from the seed layer. The seed layer functions as the cathode of an electroplating cell. Electrical contacts to the wafer are normally made at its edge. Since the seed layer is usually very thin, there is a significant resistive drop between the points of contact at the edge of the wafer and the center of the wafer. This is referred to as the "terminal effect". When the system is operating in a regime in which the plating rate is determined by the magnitude of the current, the plating rate is greater at the edge of the wafer than at the center of the wafer. As a result, the plated layer often has a concave dish-shaped profile initially. As the thickness of the copper layer increases during plating, the terminal effect diminishes and the plated layer is deposited at a more uniform rate. U.S. Pat. No. 6,074,544, issued Jun. 13, 2000 to Reid et al., which is hereby incorporated by reference, teaches a method of electroplating on a semiconductor wafer using a low current density initially to reduce resistance drop between the edge of the wafer and the center of the wafer, and then increasing the current density after the metal layer has reached a predetermined thickness.

Generally, in electroplating processes, the thickness profile of the deposited metal is controlled to be as uniform as possible. This uniform profile is advantageous in subsequent etchback or polish removal steps, as well as uniform void-free filling of the trench structures. Prior art electroplating techniques are susceptible to thickness irregularities. Factors contributing to these irregularities include the size and shape of the electroplating cell, electrolyte depletion effects, hot edge effects, and the terminal effect.

Regarding the trend towards larger diameter wafers, it is generally understood that the deposition rate, as measured by layer thickness, can be maintained by scaling total current through the electrochemical reactor in proportion to the increased surface area of the larger wafer. Thus, a 300 millimeter (mm) wafer requires 2.25 times more current than does a 200 mm wafer. Electroplating operations are preferably performed by using a clamshell-type wafer holder that contacts the wafer only at its outer radius. Due to this mechanical arrangement, the total resistance from the edge of the wafer to the center of the wafer is proportional to the radius. Nevertheless, with the higher applied current at the edge of the larger wafer, which is required to maintain the same current density for process uniformity, the total potential drop from the edge to the center of the wafer is greater for the larger diameter wafer. This circumstance leads to an increased rate of deposition that increases with radius where deposition is measured by layer thickness. While the problem of increasing deposition rate with radius exists for all wafers, it is exacerbated in the case of larger wafers.

The introduction of damascene metallization for copper interconnects has led to the development and modification of processes for 0.13 microns (μm) and smaller design rules. The implementation of new process flows has caused new device-killing defect formation. In copper damascene metallization, defects generally arise during the three main process sequences: deposition of barrier and seed layers; electrofill operations, including pre- and post-anneal; and chemical mechanical polishing (CMP).

Critical post-plating in-film killer defects in electroplated copper layers include pits, craters, and voids, which typically form during the electroplating process or during the post-plate anneal steps. Another type of defect are single isolated protrusions. Single isolated protrusions can usually be eliminated during CMP.

A conventional electroplating bath typically contains the metal to be plated together with associated anions in an acidic solution. Copper electroplating is usually performed using $CuSO_4$ and a chloride dissolved in an aqueous solution of sulfuric acid. In DC electroplating, additives such as accelerators, suppressors, and levelers are typically included in the electrolytic plating solution to improve electroplating behavior by, among others, enhancing chemical reactions, improving surface deposition, improving thickness uniformity, and enhancing filling of high aspect ratio features.

Sulfuric acid provides high conductivity to the electrolyte, and chloride ions enhance additive performance.

Three types of electroplating bath additives are in common use, subject to design choice by those skilled in the art. A suppressor additive is used to decrease the current density, and thus the deposition rate on the surface of the wafer at a given applied voltage. This allows differentiation in deposition rate between the wafer surface and the inside of high aspect ratio features, thereby enhancing the void-free fill of high aspect ratio features. Typical suppressors are large molecules, typically having an average molecular weight (MW) in a range of about from 2,000 to 6,000, that increase the surface polarization layer and prevent copper ion from readily adsorbing onto the surface. Thus, suppressors function as blockers. Suppressors cause the resistance of the surface to be very high in relation to the electroplating bath. Trace levels of chloride or other ion may be required for suppressors to be effective.

Accelerator additives accumulate within the high aspect ratio features to increase the local current density relative to the suppressed field and thus aid in void free filling. Accelerator additives are normally catalysts that accelerate the plating reaction. Accelerators typically are rather small molecules (e.g., 300 MW) that normally contain sulphur, and they need not be ionic. Accelerators adsorb onto the surface and increase the flow of current. Accelerators may occur not as the species directly added to the electroplating bath, but as breakdown products of such molecules. In either case, the net effect of accelerators is to increase current flow and accelerate the reaction when such species are present or become present through chemical breakdown.

A leveler additive is present to improve overall deposit planarity and increase the ease of subsequent CMP processing. Levelers behave like suppressors, but tend to be more electrochemically active (i.e., are more easily electrochemically transformed) than suppressors. Levelers are typically consumed during electroplating. Levelers tend to supress plating on raised regions of the surface undergoing plating, thus, tending to level the plated surface.

In conventional electroplating solutions, the additive components were designed to provide ideal characteristics for bottom-up fill of trench and vias, as well as planarization of plating above filled features. The presence of additives and chloride ions in an electrolytic plating bath, however, often leads to occlusion of undesired material in the deposited metal layer. When a damascene or dual damascene process flow scheme is used with a conventional electroplating bath, under certain conditions of wafer entry, lines of pits may result on the wafer surface. Pit defects often result in void formation in vias and trenches and subsequent yield loss.

U.S. Pat. No. 6,113,771, issued Sep. 5, 2000, to Landau et al., teaches electroplating solutions that contain various additives introduced typically in small (ppm range) amounts useful, among other reasons, for improving wetting of the part being plated. Without mentioning their purpose, U.S. Pat. No. 6,113,771 mentions polyethylene glycols as a group of additives, and it specifically mentions a polyethylene-glycol additive having an average molecular weight of 1400, and a propylene glycol additive. U.S. Pat. No. 5,969,422, issued Oct. 19, 1999, to Ting et al., teaches an electroless deposition solution that may contain polyethylene glycol as a surfactant and wetting agent. U.S. patent application Publication No. 20020064592, published May 30, 2002, for Datta et al., teaches electroless copper deposition using an electroless bath in which polyethylene glycol (5–100 ppm), polypropylene glycol and other surfactants may be used as a wetting agent.

SUMMARY OF THE INVENTION

The present invention helps to solve some of the problems outlined above by providing an electroplating solution that contains a wetting agent in addition to a suppressor and an accelerator. A plating solution in accordance with the invention improves wetting of a wafer substrate surface, thereby reducing pit defects in electroplated metal. Compared with conventional electroplating solutions, the combination of a wetting agent with a suppressor functions to achieve improved deposit appearance, desired levels of current suppression on a wafer surface, a reduction of plating-bath contact angle on a substrate surface, a reduction of solid-liquid surface tension, and a reduction in the formation of micelles or polymer agglomerates.

The invention is described herein mainly with reference to the electroplating of thin copper films in integrated circuits. It is understood, however, that electroplating solutions in accordance with the invention are also useful for electroplating other metals during integrated circuit fabrication.

A first basic embodiment of an electroplating solution in accordance with the invention comprises metal ions; an acid; an accelerator; a suppressor; and a wetting agent at a concentration not less than 5 parts per million (ppm). The wetting agent functions to lower the air-liquid surface tension of the plating solution, which improves the wetting ability of the solution. The electroplating solution preferably has an air-liquid surface tension not exceeding 60 dyne/cm$^2$ and a cloud-point temperature greater than 35° C. Typically, the concentration of suppressor is about 50 ppm or greater. Studies have shown that as the air-liquid surface tension of plating solution decreased to 50, 45 and 40 dyne/cm$^2$, the wetting ability of the solution increased and the occurrence of pit defects in metal films plated with the respective solutions decreased. In some preferred embodiments, the electroplating solution has a cloud-point temperature greater than 50° C. or even greater than 70° C. Typically, the acid in an electroplating solution in accordance with the invention comprises sulfuric acid. An electroplating solution in accordance with the invention generally also includes chloride ions and a leveler.

In some embodiments, the suppressor comprises a formulation having an average molecular weight in a range of about from 1500 to 3500 and a molar ratio of polypropylene glycol to polyethylene glycol, PPG:PEG, in a range of about from 0.2 to 0.8.

In some embodiments, the wetting agent comprises a random block co-polymer of ethylene oxide and propylene oxide having an average molecular weight in a range of about from 2000 to 8000. In other embodiments, the wetting agent comprises a block co-polymer of ethylene oxide and propylene oxide having an average molecular weight in a range of about from 2000 to 8000, the block co-polymer comprising polyethylene glycol and polypropylene glycol. An examplary wetting agent comprises BASF PLURONIC® P104 (P104). Generally, as a concentration of wetting agent increases, the air-liquid surface tension of plating solution and thereby the wafer wetting ability of plating solution increases. For example, studies have shown that a concentration of 50 ppm of a block co-polymer comprising polyethylene glycol and polypropylene glycol in an electroplating solution achieves good reduction of pit defects compared to a solution without a wetting agent.

Reduction of pit defects was enhanced progressively as the concentration of a block co-polymer comprising polyethylene glycol and polypropylene glycol was increased to 60, 80, 100 and 200 ppm. In other embodiments, a wetting agent comprises an ethoxylated alkane having an average molecular weight in a range of about from 500 to 1000 and present in the electroplating solution at a concentration not less than 80 ppm. In still other embodiments, a wetting agent comprises a chlorofluorocarbon having an average molecular weight in a range of about from 2000 to 4000 and present in the electroplating solution at a concentration in a range of about from 5 to 30 ppm.

An exemplary embodiment of an electroplating solution for plating copper includes copper ions, sulfuric acid, chloride ions, Enthone VIAFORM® suppressor, and BASF P104 wetting agent at a concentration of 50 ppm or greater, preferably 100 ppm, and more preferably 200 ppm. Another embodiment additionally includes Enthone VIAFORM® accelerator and Enthone VIAFORM® leveler.

A basic embodiment of a method in accordance with the invention for electroplating metal onto a substrate surface includes immersing a substrate into an electroplating solution comprising metal ions, an acid, an accelerator, a suppressor at a concentration not less than 50 ppm, and a wetting agent, wherein the electroplating solution has a cloud-point temperature greater than 35° C.; and generating a current in the electroplating solution between an anode and the substrate surface. An electroplating solution used in a method in accordance with the invention is characterized in that a measured liquid-solid contact angle of the electroplating solution with the substrate surface is less than 60 degrees. Generally, as the measured liquid-solid contact angle is decreased to 50, 45 and 40 degrees by decreasing the air-liquid surface tension of plating solution, the increased wetting ability of the solution results in corresponding decreases in the number and severity of pit defects in the plated metal. Typically, the substrate surface comprises a metal seed layer or other conductive metal. In some embodiments, the metal ions comprise copper ions. In an exemplary method, the acid comprises sulfuric acid, the suppressor comprises Enthone VIAFORM® suppressor, the wetting agent comprises BASF P104 at a concentration not less than 50 ppm, and the electroplating solution further comprises chloride ions. In some preferred embodiments, the electroplating solution has a cloud-point temperature greater than 50° C.

DETAILED DESCRIPTION OF PREFERRED EMBODIMENTS

Figure 1:
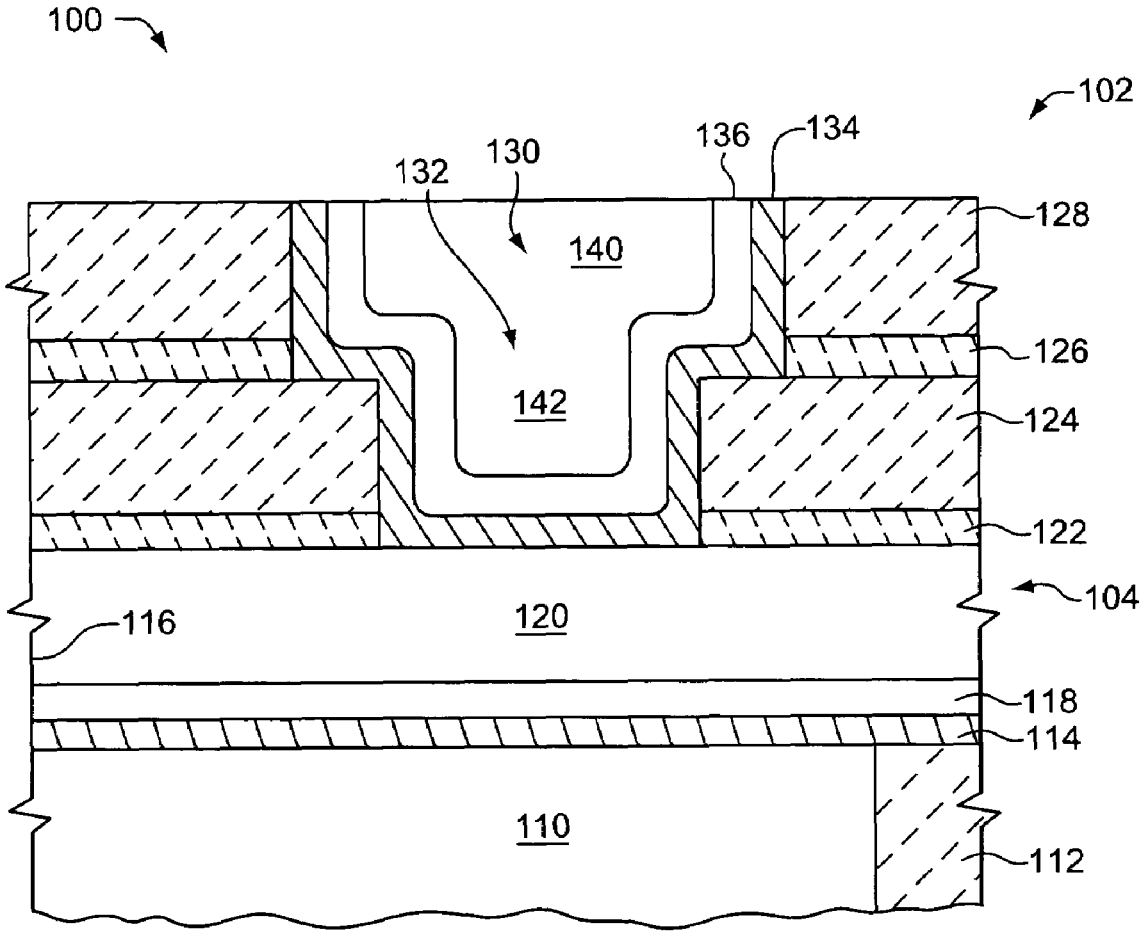
FIG. 1 depicts in schematic form a section of an integrated circuit including electroplated metal layers fabricated in accordance with the invention.
Figure 2:
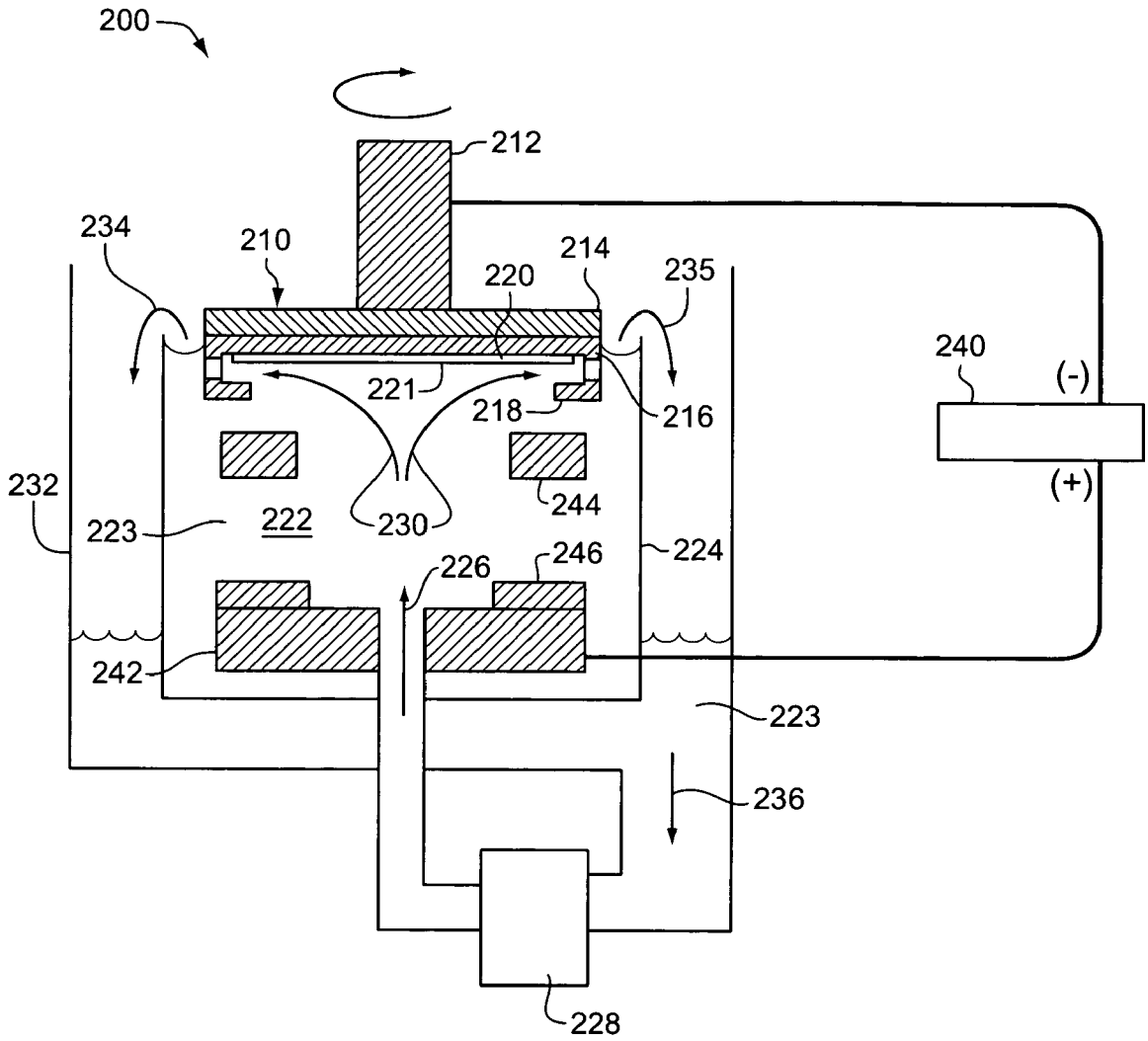
FIG. 2 depicts in schematic form a cross-sectional view of a generalized electroplating apparatus suitable for performing a method in accordance with the invention.

The invention is described herein with reference to FIGS. 1–5. It should be understood that the structures and systems depicted in schematic form in FIGS. 1 and 2 are used to explain the invention and are not precise depictions of actual structures and systems in accordance with the invention. Furthermore, the preferred embodiments described herein are exemplary and are not intended to limit the scope of the invention, which is defined in the claims below.

An electroplating solution in accordance with the invention contains a wetting agent in addition to a suppressor and an accelerator. The wetting agent serves to lower the air-liquid surface tension of plating solution, thereby enhancing the ability of the plating solution to wet a substrate surface during and after immersion of the substrate into the plating solution. Improved wetting of a wafer substrate surface helps to reduce pit defects in electroplated metal. Compared with conventional electroplating solutions, which typically contain only a polymer suppressor or a single suppressor/wetting agent, the combination in accordance with the invention of a distinct wetting agent with a distinct suppressor functions to achieve improved deposit appearance, desired levels of current suppression on a wafer surface, a reduction of plating-bath contact angle on a substrate surface, a reduction of solid-liquid surface tension, and a reduction in the formation of micelles or polymer agglomerates.

Electroplating solutions in accordance with the invention are described herein mainly with reference to copper electroplating solutions that contain copper ions. It is understood, however, that electroplating solutions in accordance with the invention are useful also for plating other metals in addition to or instead of copper. Typically, an electroplating solution in accordance with the invention is used for plating metal onto a wafer substrate having a metal seed layer, such as a seed layer containing one or more metals such as copper and ruthenium. Nevertheless, an electroplating solution in accordance with the invention is useful for plating metal onto various types of conductive surfaces.

In this specification, the terms "anode" and "cathode" refer to structures at which an oxidation and reduction process occur, respectively. In descriptions of electroplating systems and methods, the term "cathode" refers to the workpiece, typically an integrated circuit wafer, and the term "anode" refers to the counter-electrode.

The term "air-liquid surface tension" is used in the specification in its usual sense to refer to the surface tension measurable using conventional techniques between a liquid solution and air at about room temperature. Some of the exemplary electroplating processes reported below were conducted at about 15° C. because formation of pit defects is enhanced compared to formation at 25° C. Electroplating is typically conducted in an air atmosphere, but also conducted in other ambient gases, such as nitrogen or inert gases. The values of "gas-liquid surface tension" between an electroplating solution and other gases such as nitrogen and argon is substantially the same as the air-liquid surface tension at a given temperature. Therefore, in this description and in the claims below, the term air-liquid surface tension is substantially equivalent to gas-liquid surface tension.

Similarly, the term "air-solid surface tension" is used in the specification in its usual sense to refer to the surface tension measurable using conventional techniques between air and a solid surface at about room temperature. The values of "gas-solid surface tension" between a solid substrate surface and other gases such as nitrogen and argon is substantially the same as the air-solid surface tension at a given temperature. Therefore, in this description and in the claims below, the term air-solid surface tension is substantially equivalent to gas-solid surface tension.

The wetting ability of an electroplating solution in accordance with the invention depends on the combination of the gas-solid surface tension between the surface being wetted and the gaseous ambient plating atmosphere (usually air), and the gas-liquid surface tension between the electroplating solution and the ambient gas atmosphere. Embodiments in accordance with the invention are useful for making good quality plated-metal films by providing an electroplating solution that has a low gas-liquid surface tension and that also has good plating accelerator and plating suppressor characteristics.

The term "cloud point temperature" is used in specification in its usual sense to refer to a temperature at which a solute begins to precipitate out of a solution, causing the solution to become cloudy. As the temperature of a plating solution rises, the solubility of a typical polymeric wetting agent in accordance with the invention generally decreases. Precipitate resulting from precipitation of a solute at or above the cloud point temperature of a particular electroplating solution typically results in defects in the plated metal film on the substrate. The cloud point temperature of a solution depends on its general composition. As concentration of a particular wetting agent in accordance with the invention increases, cloud point temperature of the electroplating solution generally decreases. The cloud point temperature of an electroplating solution also depends on the concentrations of other solutes, such as the concentrations of a suppressor, an accelerator, metal ions, and electrolytes. Nevertheless, within practical ranges of other solute concentrations in an electroplating solution in accordance with the invention, the cloud point temperature is practically largely dependent on the concentration of wetting agent. Therefore, for a given general composition of an electroplating solution for use at a given plating temperature, there is an approximate upper limit on the concentration of a particular wetting agent that is observed to avoid precipitation of the wetting agent. The approximate upper concentration limit of a particular wetting agent depends on the solubility of the wetting agent in the electroplating solution.

It is a feature of an electroplating solution in accordance with the invention that it includes a plating suppressor and a plating accelerator in addition to a wetting agent. Studies by the inventors determined that no single chemical agent or formulation currently known in the art satisfies the functions of both a suppressor and a wetting agent. Similarly, no single chemical agent or formulation currently known in the art satisfies the functions of both an accelerator and a wetting agent.

In an electroplating solution in accordance with the invention, the function and behavior of a wetting agent and of a plating suppressor are interrelated. In a combination of wetting agent with a suppressor, the suppressor absorbs more strongly and, therefore, more uniformly to a plating surface of a substrate than the wetting agent. As a result, the suppressor dominates the electrochemical processes that occur at plating surface, resulting in good initial nucleation and uniform plating of metal. On the other hand, the wetting agent dominates the wetting of the plating surface by the electroplating solution because it provides the solution with a low air-liquid surface tension. Nevertheless, a wetting agent does not absorb well to a plating surface and, therefore, does not provide good initial nucleation and uniform plating.

Exemplary embodiments of a plating suppressor in accordance with the invention generally have a moderate molecular weight, in a range of about from 1500 to 3500, preferably about 2500 MW. Further, such exemplary embodiments substantially comprise polyethylene glycol (PEG) polymers and polypropylene glycol (PPG) polymers in roughly balanced proportions; that is, the molar ratio of PPG to PEG, PPG:PPE, is preferably in a range of about from 0.2 to 0.8. Agents having this general composition are characterized by strong and uniform adsorption properties and function well as suppressors in accordance with the invention. An example of a plating suppressor suitable for use in accordance with the invention is Enthone VIAFORM® suppressor. The functional species of VIAFORM® suppressor consists essentially of a formulation having an average molecular weight of about 2500 and a molar ratio of polypropylene glycol (PPG) to polyethylene glycol (PEG) of about 0.5. A concentration of 2 milliliter per liter (ml/l) of VIAFORM® suppressor in a plating solution corresponds to a concentration of about 200 ppm of the functional suppressor species in the plating solution.

A group of agents suitable for use as wetting agents in electroplating solutions in accordance with the invention include block co-polymers of ethylene oxide and propylene oxide having an average molecular weight in a range of about from 2000 to 8000. These include random block co-polymers of ethylene oxide and propylene oxide. Suitable wetting agents also include block co-polymers comprising polyethylene glycol (PEG) and polypropylene glycol (PPG). For example, studies by the inventors determined that a formulation commercially available from BASF having the tradename PLURONIC® P104 functions well as a wetting agent in accordance with the invention. The functional species of BASF PLURONIC® P104 consists essentially of block co-polymers of polyethylene glycol (PEG) and polypropylene glycol (PPG) having a structure corresponding to PEG-PPG-PEG, an average molecular weight of about 5900 and a molar ratio of polyethylene glycol (PEG) to polypropylene glycol (PPG) of about 0.4:0.6 (i.e., 40% PEG and 60% PPG). A concentration of 4 ml/l of BASF PLURONIC® P104 in a plating solution corresponds to a concentration of about 200 ppm of the functional wetting-agent species in the plating solution. Studies by the inventors also determined that polyethylene glycol, polyethylene oxide and formulations of related polymeric compounds alone are unsuitable as wetting agents. This is because the air-liquid surface tension of polyethylene glycol and of solutions made with it is too low to achieve satisfactory wetting ability. Similarly, studies by inventors determined that polypropylene glycol, polypropylene oxide and related compounds alone are unsuitable as wetting agents. This is because the cloud point temperature of electroplating solutions made with polypropylene glycol and related compounds is too low. On the other hand, block co-polymers of polyethylene glycol and polypropylene glycol, such as P104, enable the formulation of electroplating solutions in accordance with the invention having good wetting characteristics and a suitably high cloud point temperature. Electroplating solutions containing block co-polymers of polyethylene glycol and polypropylene glycol have a suitably high cloud point temperature because the block co-polymers have relatively good solubility in water and in electroplating solutions generally. Generally, the practical concentration range of block co-polymers of polyethylene glycol and polypropylene glycol and similar co-polymers of ethylene oxide and propylene oxide in an electroplating solution in accordance with the invention extends up to a co-polymer concentration of about 1000 ppm. In general, block co-polymers of polyethylene glycol and polypropylene glycol and of related co-polymers of ethylene oxide and propylene oxide in accordance with the invention have an average molecular weight not less than about 2000 because the inventors have observed that these block copolymers with an average molecular weight in a range of 2000 to 8000 have the desired properties of high cloud point and low surface tension.

Another group of agents suitable for use as wetting agents in electroplating solutions in accordance with the invention include polymeric ethoxylated alkanes having an average molecular weight in a range of about from 500 to 1000. Because an acid is present in electroplating solutions in accordance with the invention, it is important that an ethoxylated alkane used as wetting agent have a minimal chemical stability, which is provided by an average molecular weight not exceeding about 1000. Examples of commercially available formulations of ethoxylated alkanes suitable for use as a wetting agent include: Rhodia CA-630 ethoxylated alkane surfactant; and TERGITOL® NP-9, TERGITOL® NP-10, TERGITOL® NP-11, and TERGITOL® NP-12, available from Dow Chemicals. The concentration of one or more ethoxylated alkanes in an electroplating solution in accordance with the invention is generally in a range of about from 50 to 500 ppm.

Another group of agents suitable for use as wetting agents in electroplating solutions in accordance with the invention include polymeric chlorofluorocarbons having an average molecular weight in a range of about from 2000 to 4000. Chlorofluorocarbons in accordance with the invention have a relatively low air-liquid surface tension and are very effective in lowering the air-liquid surface tension of an electroplating solution, thereby increasing its wetting ability. On the other hand, the solubility of chlorofluorocarbons in electroplating solutions is relatively low. For these reasons, the concentration of one or more chlorofluorocarbons in an electroplating solution in accordance with the invention is generally in a range of about from 5 to 30 ppm. Examples of commercially available formulations of chlorofluorocarbons suitable for use as a wetting agent include DuPont ZONYLL® FSN surfactant and 3M FC-4430 surfactant FIG. 1 depicts in schematic form a section 100 of an integrated circuit 102 including electroplated metal layers fabricated using an electroplating solution in accordance with the invention. The structure of section 100 is exemplary, and it is understood that metal layers fabricated using a plating solution in accordance with the invention are useful in innumerable designs and types of devices of the integrated circuit art. Integrated circuit 102 disposed on semiconductor wafer 104 includes a gate region 110 and dielectric oxide 112 of an integrated circuit device. A conventional adhesion/barrier layer 114 covers the bottom and sides (not shown) of a trench 116 located above gate region 110 and dielectric oxide 112. Adhesion/barrier layer 114 typically comprises tantalum. Copper seed layer 118 formed using techniques known in the art is disposed on adhesion/barrier layer 114 and covers the inner surface of trench 116. The remainder of trench 116 is filled by electroplated copper layer 120, deposited using an electroplating solution in accordance with the invention. Integrated circuit 102 further includes dielectric barrier/etch stop layer 122, dielectric oxide layer 124, dielectric barrier/etch stop layer 126, and dielectric oxide layer 128, as known in the art. Using patterning and etching techniques known in the art, a trench 130 and via 132 have been formed. A second adhesion/barrier layer 134 lines the sides and bottoms of trench 130 and via 132. A second copper seed layer 136, formed using techniques known in the art, is deposited on adhesion/barrier layer 134 and lines the inside surfaces of trench 130 and via 132. The remaining portions of trench 130 and via 132 are filled by electroplating copper deposited using an electroplating solution in accordance with the invention, to form conductive interconnect 140 and conductive plug 142. As depicted in FIG. 1, conductive copper interconnect 140 is substantially perpendicular to copper layer 120, and conductive copper plug 142 serves to connect electrically conductive copper interconnect 140 to copper layer 120.

FIG. 2 depicts in schematic form a cross-sectional view of a generalized electroplating apparatus 200 suitable for using an electroplating solution in accordance with the invention. Apparatus 200 includes a clamshell wafer holder 210 mounted on a rotatable spindle 212, which allows rotation of clamshell 210 at a controllably variable rotation rate. A clamshell wafer holder 210 has been described in commonly-owned U.S. Pat. No. 6,156,167, issued Dec. 5, 2002 to Patton et al., which is hereby incorporated by reference. Clamshell 210 comprises a cone 214, a cup 216, and a flange 218. Flange 218 is known in the art, and is implemented in various forms to control the DC current density at the edge of a wafer and thereby reduce the "terminal effect" during initial stages of electroplating. For electroplating, a wafer 220 having plating surface 221 is mounted in cup 216. Clamshell 210 and wafer 220 are immersed in a plating bath 222 containing an electroplating solution 223 and located in bath container 224. As indicated by arrow 226, plating solution 223 is continually delivered into bath container 224 by a pump 228. Generally, plating solution 223 flows upwards towards the center of wafer 220 and then radially outwards and across wafer plating surface 221, as indicated by arrows 230. The plating solution then overflows bath container 224 and flows into overflow reservoir 232, as indicated by arrows 234, 235. The plating solution is then filtered (not shown) and returned to pump 228, as indicated by arrow 236.

A DC power supply 240 and a negative output lead are electrically connected to wafer 220 through one or more rings, brushes, and contacts (not shown) mounted in wafer holder 210. The positive output lead of power supply 240 is electrically connected to an anode 242 located in plating bath 222 at the bottom of bath container 224. Shields 244,246 are provided to shape the electric field between anode 242 and cathode wafer 220. Preferably, flange 218 and shields 244, 246 are dynamically variable, as disclosed in U.S. Pat. No. 6,402,923 B1, issued Jun. 11, 2002 to Mayer et al., and in U.S. patent application Publication No. 20020195352, published Dec. 26, 2002, which are hereby incorporated by reference. An apparatus suitable for using an electroplating solution in accordance with the invention is disclosed in U.S. patent application Publication No. 20020195352, published Dec. 26, 2002, incorporated by reference.

Figure 3:
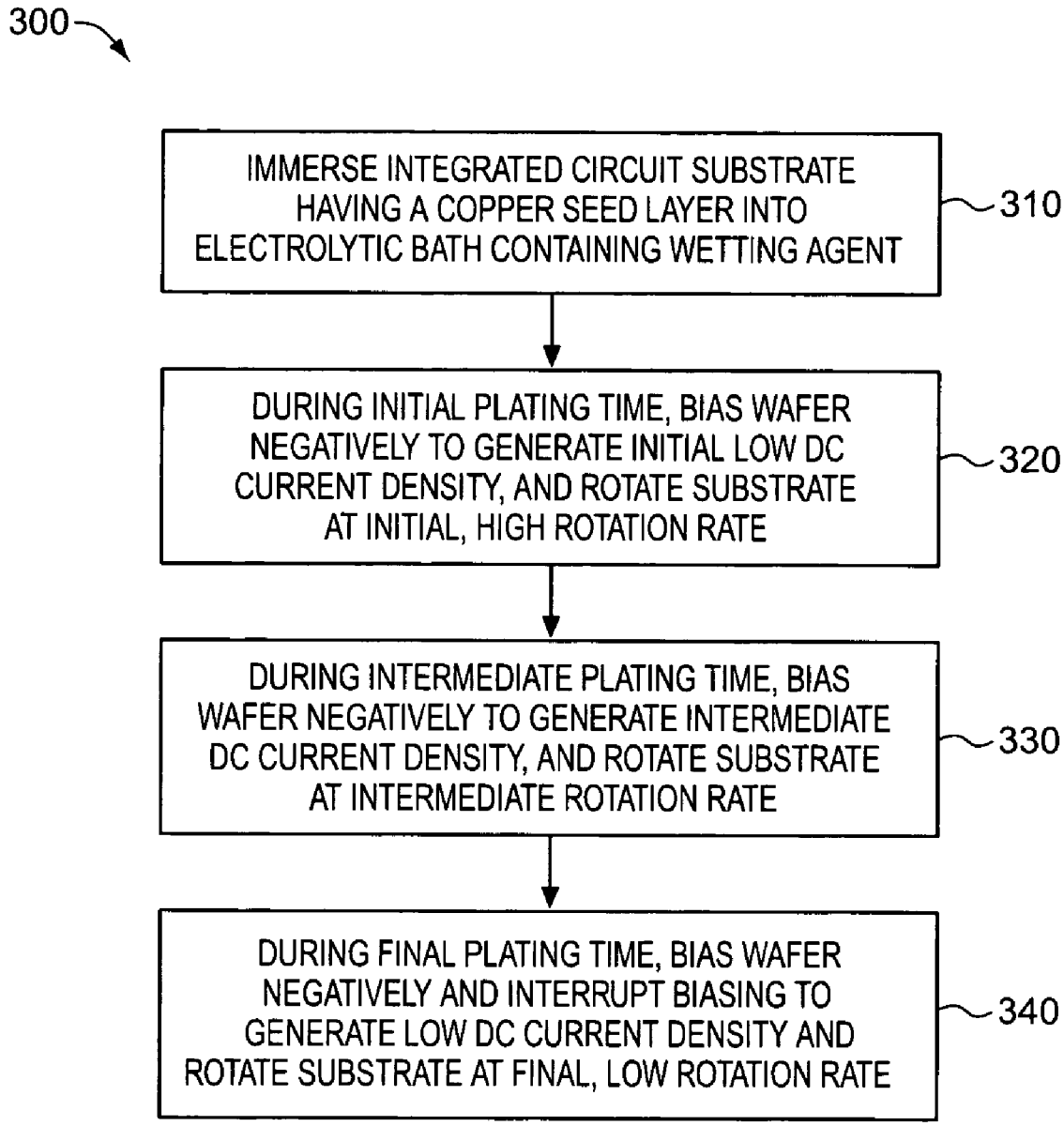
FIG. 3 contains a process flow sheet of a generalized preferred method for electroplating copper using an electroplating solution in accordance with the invention.

FIG. 3 contains a process flow sheet of a generalized method 300 for utilizing electroplating solution in accordance with the invention. Method 300 is described herein with reference to apparatus 200 of FIG. 2, although it is understood that a method for utilizing a plating solution in accordance with the invention can be practiced using a wide variety of apparati. In processes 310, integrated circuit substrate wafer 220, typically having a copper seed layer, is immersed into electrolytic bath 222 comprising electroplating solution 223 in accordance with the invention by lowering substrate holder 210 into bath container 224. Electrolytic plating solution 223 comprises copper ions and additives known in the art, in particular, a suppressor, a wetting agent, and an accelerator. The presence of a wetting agent in accordance with the invention in the plating solution improves the wetting of wafer surface 221 (typically a metal seed layer) to reduce pit defects related to wafer entry into plating bath 222. An electroplating solution in accordance with the invention is partly characterized in that the solution has a cloud-point temperature greater than 35° C. and also in that a measured liquid-solid contact angle of the liquid electroplating solution with deposition surface 221 is less than 60 degrees. Alternatively, an electroplating solution in accordance with the invention is partly characterized by having both an air-liquid surface tension not exceeding 50 dyne/$cm^2$ and a cloud-point temperature greater than 35° C. Preferably, processes 310 include rotating substrate wafer 220 while immersing it to reduce formation of bubbles on deposition surface 221 and to remove any bubbles that form during immersion. In processes 320, during an initial plating time, a negative bias is applied to substrate wafer 220, which acts as a cathode, and a positive bias is applied to anode 242, thereby generating an initial low DC current of electrolytes toward wafer deposition surface 221. Preferably, in processes 320, substrate wafer 220 is rotated at an initial, high rotation rate to enhance mass transfer of plating-solution solutes at deposition surface 221. Processes 330 include applying a negative bias to substrate wafer 220, during an intermediate plating time, to generate an intermediate DC current of electrolytes toward wafer deposition surface 221. Processes 330 also include rotating substrate wafer 220 at an intermediate rotation rate, which may or may not be different from the initial rotation rate of processes 320. Processes 340 include applying a negative bias to substrate wafer 220 during a final plating time to generate a DC current of electrolytes toward substrate surface 221, but preferably at a lower current density than during the first plating time and the intermediate plating time. Processes 340 also preferably include rotating substrate wafer 220 at a final, low rotation rate that is slower than the first rotation rate or the intermediate rotation rate.

Alternatively, processes 340 include applying a negative bias to substrate wafer 220 during a final plating time and interrupting the biasing during a plurality of short pauses. During the bias-off-time of the pauses, substantially zero DC current is generated. During the bias-on-time of the final plating time, a DC current of electrolytes is generated toward substrate surface 221, but preferably at a lower current density than during the first plating time and the intermediate plating time. Typically, substrate wafer 220 is rotated at the final, low rotation rate during bias-off-times of pauses, as well as during bias-on-times. Alternatively, processes 340 include rotating the substrate wafer during a bias-off-time at a bias-off-time rotation rate that is faster than the final, low rotation rate, which is usually applied during bias-on-times. Selection of values of the various operating variables (e.g., rotational speeds, current densities, bias-on and bias-off times) is based on numerous factors including, among others, composition of plating solution, desired deposition rate, desired plating film thickness, substrate surface area, and plating temperature. A method of electroplating using DC current interruption and variable rotation rate is described in co-owned and copending U.S. patent application Ser. No. 10/441,607, filed May 20, 2003, now U.S. Pat. No. 6,884,335, which is hereby incorporated by reference.

Certain embodiments of methods using an electroplating solution in accordance with the invention compensate for electrical resistance and voltage drop across the wafer, particularly during phases of electrochemical treatment when the conductive metal film at the treatment surface of the substrate is especially thin; for example, at the beginning of an electroplating process when a thin seed layer dominates DC current flow and voltage drop, or in later stages of an electropolishing operation. Such compensation is generally conducted by shaping a potential drop in the electrolyte bath corresponding but inverse to the electrical resistance and voltage drop across the wafer substrate, thereby achieving a uniform (or tailored, if desired) current distribution. As the electroplated layer becomes thicker and the terminal effect decreases, some embodiments of methods of using a plating solution in accordance with the invention effect a transition to a uniform plating distribution by dynamically varying the electrical field and current source that the wafer experiences, as disclosed in U.S. Pat. No. 6,402,923 B1, issued Jun. 11, 2002 to Mayer et al., and in U.S. patent application Publication No. 20020195352, published Dec. 26, 2002, which are incorporated by reference.

An exemplary plating solution in accordance with the invention comprises 40 grams per liter (g/l) of dissolved copper metal, added as copper sulfate pentahydrate ($CuSO_4 \cdot 5H_2O$); 10 g/l $H_2SO_4$; 50 milligrams per liter (mg/l) chloride ion, added as HCl; 6 milliliters per liter (ml/l) VIAFORM® accelerator; 2.5 ml/l VIAFORM® leveler; 2 ml/l (i.e., about 200 ppm) VIAFORM® suppressor; and 4 ml/l (i.e., about 200 ppm) BASF PLURONIC® P104. The functional species of VIAFORM® accelerator consists essentially of bis-(3-sulfopropyl)-disulfide (SPS). A concentration of 6 ml/l of VIAFORM® accelerator in a plating solution corresponds to a concentration of about 30 ppm of the functional accelerator species in the plating solution. The functional species of VIAFORM® leveler consists essentially of poly(vinyl pyrrolidone) (PVP) having an average molecular weight in a range of about from 3,000 to 5,000. A concentration of 2 ml/l of VIAFORM® leveler in a plating solution corresponds to a concentration of about 2 ppm of the functional leveler species in the plating solution. For electroplating a corresponding copper layer at room temperature onto a 200 mm wafer to a thickness of 0.7 μm in accordance with method 300 of FIG. 3, typical ranges of operating parameters are represented by the following: an initial DC current density in a range of about from 1 mA/$cm^2$ to 8 mA/$cm^2$ for an initial plating time in a range of about from 4 seconds to 60 seconds, at an initial rotation rate in a range of from 50 rpm to 200 rpm, typically about 125 rpm; an intermediate DC current density in a range of about from 5 mA/$cm^2$ to 20 mA/$cm^2$ for an intermediate plating time of about from 10 seconds to 120 seconds, at an intermediate rotation rate in a range of from 50 rpm to 200 rpm, typically about 125 rpm; and a final DC current density in a range of about from 25 mA/$cm^2$ to 110 mA/$cm^2$ for a final plating time in a range of about from 15 seconds to 120 seconds, at a final rotation rate in a range of from 5 rpm to 40 rpm, typically about 10 rpm.

EXAMPLE 1

A Novellus Model SABRE® xT apparatus was used to electroplate copper on integrated circuit substrate wafers using various electroplating solutions containing different amounts of BASF PLURONIC® P104 ("P104") wetting agent. Copper was electroplated on a series of 200 mm silicon wafers having a PVD copper seed layer with a thickness of approximately 100 nm. Process specifications of a standard SABRE® xT copper DC electrofill process are known in the art.

Each of five plating solutions contained: 40 g/l of dissolved copper metal, added as copper sulfate pentahydrate ($CuSO_4 \cdot 5H_2O$); 10 g/l $H_2SO_4$; 50 mg/l chloride ion, added as HCl; 6 ml/l VIAFORM® accelerator; 2.5 ml/l VIAFORM® leveler; and 2 ml/l VIAFORM® suppressor. In addition, the five different plating solutions comprised a concentration of P104 corresponding to 0, 10, 50, 80, and 100 ppm, respectively. The VIAFORM® accelerator, suppressor, and leveler are commercially available from Enthone Company. PLURONIC® P104 is commercially available from BASF.

Copper plating was conducted at a low bath temperature of about 15° C. The plating solution was pumped into the plating chamber at a volumetric flow rate of about 12 liters per minute. The distance between the cathodic plating surface of the wafer and the top surface of the anode was about 10 mm. After immersion of a substrate wafer into the plating solution, the wafer cathode was rotated at 125 rpm and negatively biased during a first plating time of 5.5 seconds to generate a DC current of 2 amp between the anode and the cathode, which corresponds to a DC current density of approximately 6.4 $mA/cm^2$ at the deposition surface of the 200 mm wafer. During an intermediate plating time of 30 seconds, the wafer was rotated at 125 rpm and a negative bias was applied to generate a DC current of 3 amps, corresponding to a current density of 10 $mA/cm^2$ at the deposition surface of the wafer. Then, during a final plating time, the wafer was rotated at 18 rpm and a negative bias was applied during 26.3 seconds, thereby generating a DC current of 18 amps, corresponding to a current density of 57 $mA/cm^2$. The resulting layer deposited on each wafer had a thickness of approximately 0.7 μm, or 700 nm.

Each plating solution was used to deposit copper on three different wafers, so that copper was electroplated on a total of 15 wafers. After electroplating, the wafers were examined for defects using KLA Tencor AIT II metrology tool and visual inspection using an optical microscope in darkfield mode. The results are tabulated in Table 1.

TABLE 1

| P104 Concentration | Wafer 1 | Wafer 2 | Wafer 3 |
|---|---|---|---|
| 0 ppm | Pits | Pits | Pits |
| 10 ppm | Pits | Pits | Pits |
| 50 ppm | No Pits | Pits | No Pits |
| 80 ppm | No Pits | No Pits | No Pits |
| 100 ppm | No Pits | No Pits | No Pits |

The results show that on wafers electroplated with plating solutions in accordance with the invention having P104 concentrations of 80 and 100 ppm, lines of pits were not observed. At a concentration of 0 ppm and 10 ppm, however, numerous lines of pits were observed.

EXAMPLE 2

The effectiveness of plating solutions in accordance with the invention in reducing lines of pits on wafers was studied. Three different plating solutions having compositions similar to those in Example 1 were prepared, except that the concentrations of P104 were 0, 100 and 200 ppm, respectively. A series of 200 mm silicon wafers having a PVD copper seed layer with a thickness of approximately 100 nm were etched with 10% sulfuric acid solution prior to electroplating. The etching with sulfuric acid, and other similar etching techniques, typically creates lines of pit defects under conventional operating conditions. Each of the three plating solutions was used to deposit copper on three different wafers, so that copper was electroplated on a total of nine wafers. Electroplating conditions and techniques essentially identical to those used in Example 1 were utilized.

Figure 4:
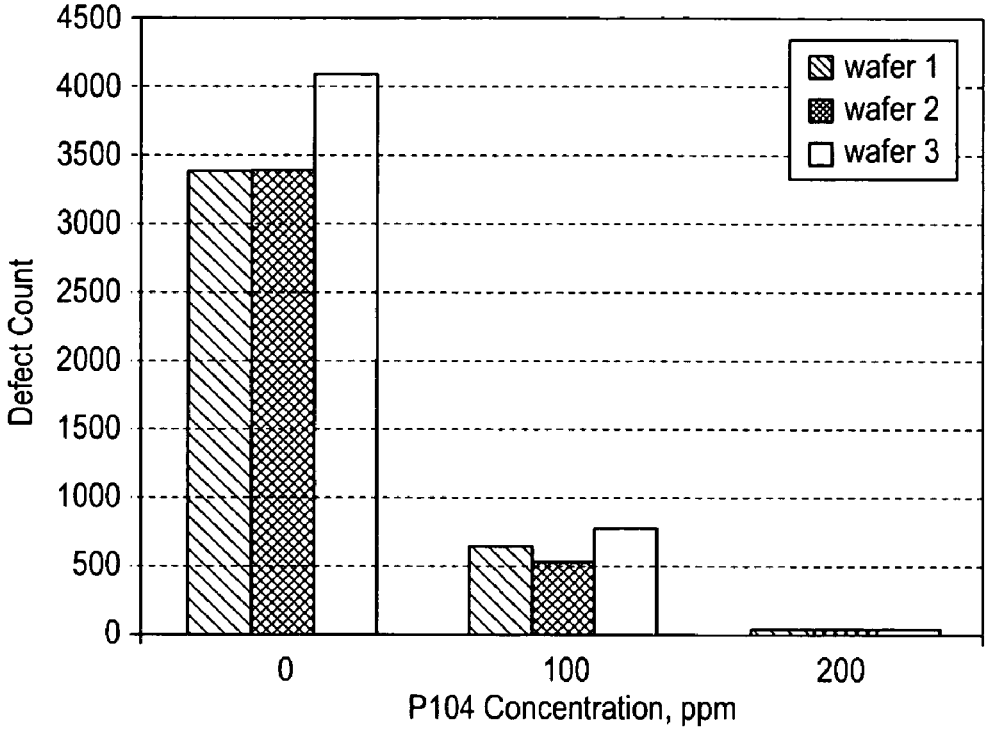
FIG. 4 contains a graph in which pit defect count, represented by a bar for each examined wafer, is plotted as a function of wetting agent concentration in the plating solution.

After electroplating, the wafers were examined for defects using KLA Tencor AIT II metrology tool and visual inspection using an optical microscope in darkfield mode. The results are shown in FIG. 4. As depicted in FIG. 4, wafers plated with a conventional plating solution containing 0 ppm P104 wetting agent exhibited high defect counts in a range of about from 3500 to 4000 defects per wafer. In contrast, wafers plated with a plating solution in accordance with the invention comprising 100 ppm P104 wetting agent had much lower defect count, in a range of about 500 to 800 defects per wafer. Wafers plated with a plating solution in accordance with the invention comprising 200 ppm P104 wetting agent had only about 50 or less defects per wafer.

EXAMPLE 3

The impact of using a plating solution in accordance with the invention on trench-filling ability was evaluated. A conventional plating solution having a composition similar to those in Example 1 had a composition of 0 ppm P104. A plating solution in accordance with the invention contained 200 ppm P104. A series of 200 mm silicon wafers were prepared to contain trenches having a width of either 0.2 μm or 0.3 μm and an aspect ratio of approximately 4 and 2.7, respectively. A PVD copper seed layer with a thickness of approximately 100 covered the surfaces of each wafer. Each of the two plating solutions was used to deposit copper on a wafer having a 0.2 μm or 0.3 μm trenches. Electroplating conditions and techniques essentially identical to those used in Example 1 were utilized. No degradation of electroplating trench-filling performance was observed on any of the wafers on which copper was deposited using the plating solution in accordance with the invention.

EXAMPLE 4

Electroplating was conducted on various wafers using plating solutions containing BASF PLURONIC® P104 as a wetting agent in the presence and absence of various suppressors. Each plating solution contained: 40 g/l of dissolved copper metal, added as copper sulfate pentahydrate ($CuSO_4 \cdot 5H_2O$); 10 g/l $H_2SO_4$; 50 mg/l chloride ion, added as HCl; 6 ml/l VIAFORM® accelerator; 2.5 ml/l VIAFORM® leveler. A first plating solution contained 200 ppm P104 wetting agent and no suppressor. A second plating solution contained 200 ppm P104 wetting agent and 200 ppm PEG 1000 suppressor. A third plating solution contained 200 ppm P104 wetting agent and 200 ppm Enthone VIAFORM® suppressor. A fourth plating solution contained 200 ppm P104 wetting agent and 200 ppm Shipley suppressor.

Each of the four plating solutions was used to deposit copper on a different wafer, so that copper was electroplated on a total of four wafers. Each wafer had a PVD copper seed layer with a thickness of approximately 100. Electroplating conditions and techniques essentially identical to those used in Example 1 were utilized. After electroplating copper, the appearance of the wafers was examined and defects were evaluated by KLA Tencor AIT II metrology tool and visual inspection using an optical microscope in darkfield mode. The results are tabulated in Table 2.

TABLE 2

| Wetting Agent and Suppressor | Appearance | Isolated Pits |
|---|---|---|
| P104 only | Poor | Many |
| P104 + PEG 1000 | Poor | Many |
| P104 + VIAFORM ® Suppressor | Good | None |
| P104 + Shipley Suppressor | Poor | None |

The data of Table 2 show that when P104 was used alone as a wetting agent and a suppressor, or in combination with 200 ppm PEG 1000, poor deposit appearance and isolated pits were observed. The isolated pits were most likely due to the formation of agglomerates of P104 that adsorbed on the wafer surface during nucleation. The term "poor appearance" refers to a metal deposit characterized by nonuniformities and by hazy (non-bright) areas on the deposited metal surface. The presence of PEG 1000 did not eliminate pitting or poor nucleation. However, the combination of Enthone VIAFORM® suppressor with P104 resulted in good deposit appearance and eliminated isolated pit formation. The term "good appearance" refers to a metal deposit characterized by a uniform, bright metal surface. The addition of Shipley suppressor eliminated isolated pits but did not significantly improve the appearance of the electroplated copper.

VIAFORM® suppressor has an average molecular weight of about 2500 and comprises amounts of PPG and PEG having a PPG:PEG molar ratio of about 50:50. PEG 1000 has a lower molecular weight, in a range of about 1000, and does not contain PPG. As a result, compared with a suppressor in accordance with the invention, such as VIAFORM® suppressor, PEG 1000 has a lower degree of adsorption strength. It is believed that the lower adsorption strength of PEG 1000 allowed too much relative absorption of wetting agent P104 onto the plating surface. The relatively poor adsorption of PEG 1000 and the undesirable adsorption of P104 caused pit defects and nonuniform plating.

Shipley Suppressor has a moderate average molecular weight of roughly 2000, but comprises a low molar proportion of PPG (PPG:PEG ratio roughly one-fourth). As a result, Shipley suppressor adsorbs better than PEG 1000, but it still does not adsorb as well as VIAFORM® suppressor. Accordingly, when Shipley suppressor was used together with P104, no pits were observed, but the electroplated copper showed nonuniformities.

In general, moderate molecular-weight polymers (e.g., MW of from 1500 to 3500) show more uniform adsorption than higher molecular-weight polymers. Also, as the ratio PPG:PEG increases, adsorption of a suppressor to a plating surface increases. On the other hand, if the concentration of PPG becomes too high, it becomes insoluble in the plating solution. For this reason, a suppressor having a moderate average molecular weight and a moderate PPG:PEG ratio, such as VIAFORM® suppressor, is well-suited for use in an electroplating solution in accordance with the invention.

EXAMPLE 5

The correlation between liquid-air surface tension and liquid-solid wetting angle was studied. The wetting ability of an electrolyte solution is often characterized through air-liquid surface tension measurements. On the other hand, since the wetting of a substrate surface also depends on the liquid-solid surface tension between a plating solution and a substrate surface, a value of air-liquid interfacial surface tension alone would not necessarily be representative of the ability of the plating bath to wet a PVD copper seed wafer. Therefore, a liquid-solid contact angle has often been used for primary evaluation of the wetting ability of a plating bath. A drawback of contact angle measurements is the theoretical dependence of wetting ability on the incoming seed condition. In order to compensate for wafer to wafer variation, measurement of the contact angle of a control is recommended for various plating surfaces and operating conditions in methods conducted in accordance with the invention. It should be noted, however, that variations in the conditions of metal-containing plating surfaces typically are not substantial enough to negate the beneficial wetting ability of plating solutions containing a wetting agent in accordance with the invention.

A solution of 200 ppm BASF P104 block copolymer in $H_2O$ and a solution of VIAFORM® suppressor were prepared and their physical properties were measured at room temperature using conventional means. The results are tabulated in Table 3.

TABLE 3

| Polymer @ 200 ppm in water | Molecular Weight | Contact Angle | Surface Tension (dyne/cm) | Cloud Point T (°C.) | Foam Height (mm) |
|---|---|---|---|---|---|
| VIAFORM ® Suppressor | 2500 | 69.4° | 69 | 77° C. | 10 |
| P104 BASF | 5900 | 41.5° | 55 | 65° C. | 15 |

The data of Table 3 show a strong correspondence between air-liquid surface tension and liquid-solid contact angle. The solution of P104 in water had an air-liquid surface tension value of 55 dyne/cm and a corresponding liquid-solid contact angle with a PVD copper seed layer of 41.5°. In contrast, the solution of VIAFORM® Suppressor in water had an air-liquid surface tension value of 69 dyne/cm and a corresponding liquid-solid contact angle with a PVD copper seed layer of 69.4°. In addition, the solution of P104 had a satisfactory cloud point temperature of 65° C., and a satisfactory foam height of 15 mm at room temperature. The measured air-liquid surface tension value of another solution of P104 at a concentration of 1000 ppm in water was about 38.5 dyne/cm.

EXAMPLE 6

The correlation between liquid-solid wetting angle and concentration of wetting agent in an electrolytic plating solution was studied.

A series of plating solutions were prepared as in Example 1, each containing: 40 g/l of dissolved copper metal, added as copper sulfate pentahydrate ($CuSO_4 \cdot 5H_2O$); 10 g/l $H_2SO_4$; 50 mg/l chloride ion, added as HCl; 6 ml/l VIAFORM® accelerator; 2.5 ml/l VIAFORM® leveler; and 2 ml/l VIAFORM® suppressor. In addition, the different plating solutions comprised a concentration of P104 corresponding to approximately 0, 10, 50, 100, 200, 400 and 1000 ppm, respectively.

Figure 5:
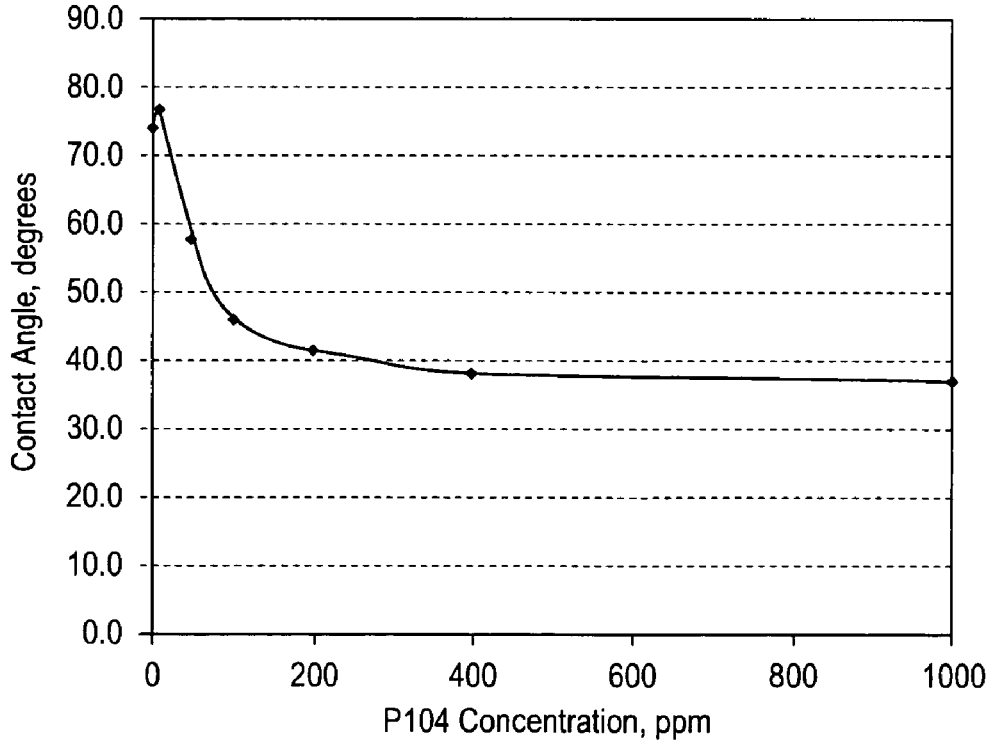
FIG. 5 shows a graph in which the measured contact angle between a plating solution in accordance with the invention and a PVD copper seed layer is plotted as a function of wetting agent concentration in the plating solution.

FIG. 5 shows the liquid-solid contact angle of a plating solution as a function of P104 concentration. The data of FIG. 5 show that the liquid-solid contact angle decreases with increasing concentration of wetting agent. The liquid-solid contact angle decreased rapidly with increasing concentration of wetting agent up to a concentration of about 100 ppm, and then leveled off at less than 400 at concentrations exceeding 200 ppm. The data in Table 1 of Example 1 above showed an apparent absence of pits in wafers plated using a plating solution in accordance with the invention having a concentration of P104 wetting agent of 80 ppm or higher.

Compositions and methods in accordance with the invention are useful in a wide variety of circumstances and applications. It is evident that those skilled in the art may now make numerous uses and modifications of the specific embodiments described, without departing from the inventive concepts. It is also evident that the steps recited may, in some instances, be performed in a different order; or equivalent compositions, structures and processes may be substituted for the compositions, structures and processes described. Since certain changes may be made in the compositions and methods without departing from the scope of the invention, it is intended that all subject matter contained in the above description or shown in the accompanying drawings be interpreted as illustrative and not in a limiting sense. Consequently, the invention is to be construed as embracing each and every novel feature and novel combination of features present in or inherently possessed by the electroplating solutions and methods described in the claims below and by their equivalents.

The invention claimed is:

1. An electroplating solution, comprising:

copper metal ions;

sulfuric acid at a concentration of about 10 grams per liter;

chloride ions at a concentration of about 50 milligrams per liter;

an accelerator at a concentration of about 30 parts per million (ppm), said accelerator consisting essentially of bis-(3-sulfopropyl)-disulfide (SPS);

a leveler at a concentration of about 2 ppm, said leveler consisting essentially of poly(vinyl pyrrolidone) (PVP) having an average molecular weight in a range of about from 3000 to 5000;

a suppressor at a concentration of about 200 ppm; and a wetting agent at a concentration in a range of about from 80 ppm to 200 ppm;

wherein said suppressor consists essentially of a formulation having an average molecular weight of about 2500 and a molar ratio of polypropylene glycol (PPG) to polyethylene glycol (PEG) of about 0.5; and said wetting agent consists essentially of a block copolymer of polyethylene glycol and polypropylene glycol having an average molecular weight of about 5900 and a molar ratio of polyethylene glycol (PEG) to polypropylene glycol (PPG) of about 0.4:0.6.

2. An electroplating solution as in claim 1, wherein:

said electroplating solution has an air-liquid surface tension not exceeding 60 dyne/cm$^2$.

3. An electroplating solution as in claim 2, wherein said air-liquid surface tension does not exceed 50 dyne/cm$^2$.

4. An electroplating solution as in claim 2, wherein said air-liquid surface tension does not exceed 45 dyne/cm$^2$.

5. An electroplating solution as in claim 2, wherein said air-liquid surface tension does not exceed 40 dyne/cm$^2$.

6. An electroplating solution as in claim 1, wherein:

said electroplating solution has a cloud-point temperature greater than 35° C.

7. An electroplating solution as in claim 6, wherein said electroplating solution has a cloud-point temperature greater than 50° C.

8. An electroplating solution as in claim 6, wherein said electroplating solution has a cloud-point temperature greater than 70° C.

9. An electroplating solution as in claim 1, wherein said wetting agent is present in said electroplating solution at a concentration not less than 100 ppm.

10. An electroplating solution as in claim 9, wherein said wetting agent is present in said electroplating solution at a concentration of about 200 ppm.

11. A method of electroplating metal onto a substrate surface, comprising the steps of:

immersing a substrate into an electroplating solution; and generating a current in said electroplating solution between an anode and said substrate surface, said substrate surface functioning as a cathode;

wherein said electroplating solution comprises:

copper metal ions;

sulfuric acid at a concentration of about 10 grams per liter;

chloride ions at a concentration of about 50 milligrams per liter;

an accelerator at a concentration of about 30 parts per million (ppm), said accelerator consisting essentially of bis-(3-sulfopropyl)-disulfide (SPS);

a leveler at a concentration of about 2 ppm, said leveler consisting essentially of poly(vinyl pyrrolidone) (PVP) having an average molecular weight in a range of about from 3000 to 5000;

a suppressor at a concentration of about 200 ppm; and a wetting agent at a concentration in a range of about from 80 ppm to 200 ppm;

wherein said suppressor consists essentially of a formulation having an average molecular weight of about 2500 and a molar ratio of polypropylene glycol (PPG) to polyethylene glycol (PEG) of about 0.5; and said wetting agent consists essentially of a block copolymer of polyethylene glycol and polypropylene glycol having an average molecular weight of about 5900 and a molar ratio of polyethylene glycol (PEG) to polypropylene glycol (PPG) of about 0.4:0.6.

12. A method as in claim 11, wherein a measured liquid-solid contact angle of said electroplating solution with said substrate surface is less than 60 degrees.

13. A method as in claim 12, wherein said measured liquid-solid contact angle is less than 50 degrees.

14. A method as in claim 13, wherein said measured liquid-solid contact angle is less than 45 degrees.

15. A method as in claim 14, wherein said measured liquid-solid contact angle is less than 40 degrees.

16. A method as in claim 11, wherein said substrate surface comprises a metal seed layer.

* * * * *